United States Patent [19]

Jansson et al.

[11] 4,137,572

[45] Feb. 6, 1979

[54] PROTECTIVE GLOVE, ESPECIALLY INTENDED FOR ICE HOCKEY PLAYERS

[75] Inventors: Janne K. G. Jansson; Leif H. Skottheim, both of Malung, Sweden

[73] Assignee: Jofa AB, Malung, Sweden

[21] Appl. No.: 862,512

[22] Filed: Dec. 20, 1977

[30] Foreign Application Priority Data

Dec. 20, 1976 [SE] Sweden ..... 7614303

[51] Int. Cl.[2] ..... A41D 13/10

[52] U.S. Cl. ..... 2/16; 2/161 A

[58] Field of Search ..... 2/16, 20, 159, 161 R, 2/161 A, 165, 167

[56] References Cited

U.S. PATENT DOCUMENTS

| | | | |
|---|---|---|---|
| 3,626,515 | 12/1971 | Murray | 2/161 A X |
| 3,707,730 | 1/1973 | Slider | 2/161 A |
| 4,027,339 | 6/1977 | Brucker | 2/161 A X |
| 4,042,975 | 8/1977 | Elliott, Jr. et al. | 2/161 A X |
| 4,047,250 | 9/1977 | Norman | 2/161 A |

*Primary Examiner*—Werner H. Schroeder
*Assistant Examiner*—Moshe I. Cohen
*Attorney, Agent, or Firm*—Young & Thompson

[57] ABSTRACT

A protective glove, especially intended for ice hockey players, comprises a portion encircling the hand and a cuff encircling the wrist and lower part of the forearm. The portion encircling the hand and the cuff are provided partly with paddings covering the upper side of the fingers, hand and wrist, and partly with a padding covering the outer side of the thumb. In the outer side of the padding covering the thumb there is arranged a stiff protective strip extending beyond the thumb root and down into the cuff up to the vicinity of the edge of the cuff.

8 Claims, 3 Drawing Figures

PROTECTIVE GLOVE, ESPECIALLY INTENDED FOR ICE HOCKEY PLAYERS

Figure 1:
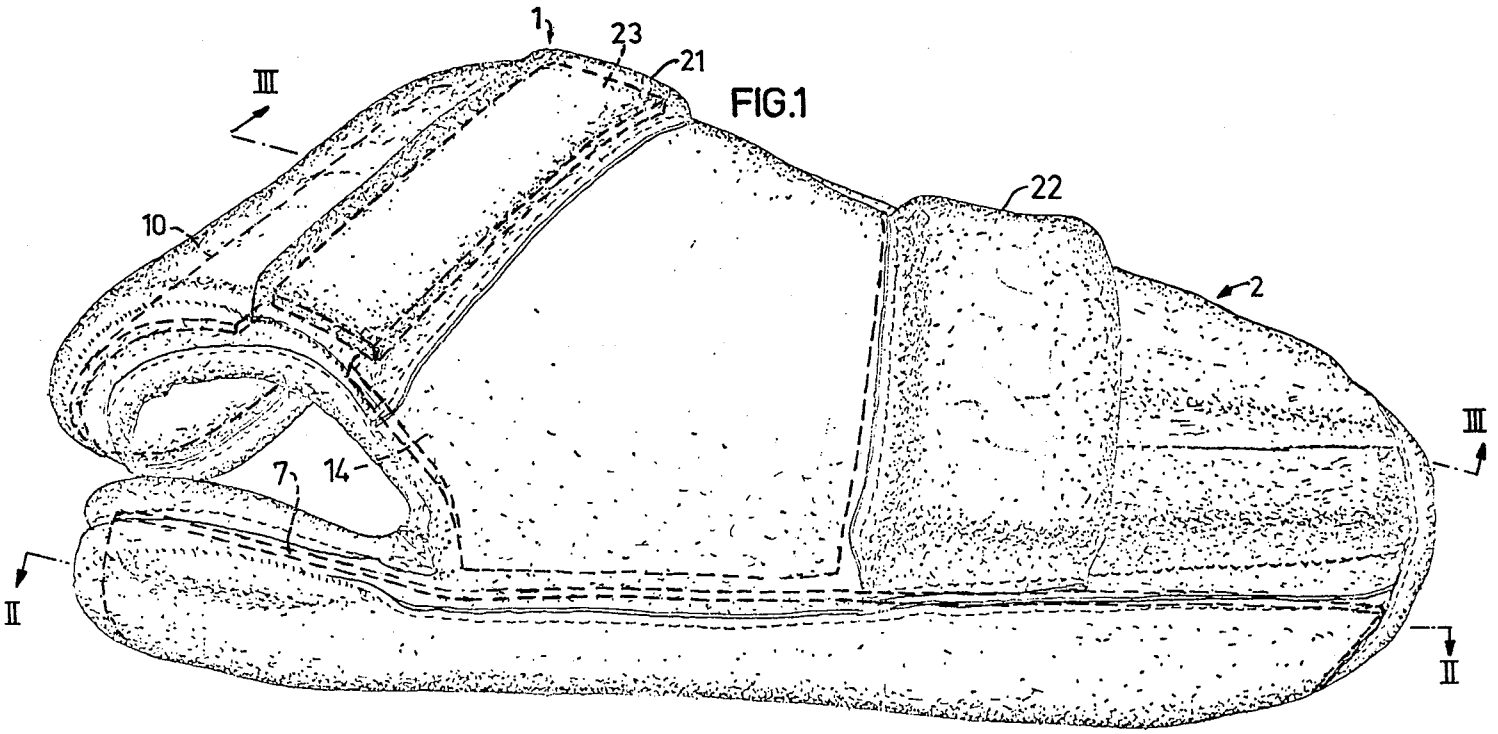

The present invention relates to a protective glove which is especially intended for ice hockey players.

Such protective gloves are already known and consist of a portion which encircles the hand and wrist and a cuff which encircles the lower forearm, in which the portion which encircles the hand and the cuff are provided partly with padding which covers the upper side of the fingers, hand and wrist, and partly with a padding which covers the outer side of the thumb and in which a stiff protective strip is arranged in the padding which covers the outer side of the thumb.

These known gloves usually have finger stalls in which the protective padding for the fingers takes the form of long and narrow cushions which extend lengthwise from the top of the finger to the inner joint of each finger, and are often provided with at least one transverse weakening in order to facilitate the bending of the fingers. The paddings for protection of the back of the hand usually consist of a number of transverse long and narrow cushions which are separated from each other in order to allow bending of the hand.

Protection for the thumb is provided by a padded cushion which extends along the outer side of the thumb and in which a relatively stiff protective strip is embedded. This protective strip extends from the top of the thumb to the outer edge of the inner joint of the thumb. A further padding or cushion is so arranged that the transverse inner edge thereof lies approximately on a level with the wrist, the outer transverse edge being on a level with the inner joint of the thumb and the inner longitudinal edge being aligned with the grip of the thumb. Finally, a long and narrow cushion is placed between the last-mentioned inner edge and the ends of the cushions which extend along the back of the hand.

Some thinner padded cushions are also provided in the cuff of the glove along the upper forearm and a relatively stiff protective plate with padding can be placed in the cuff in order to cover the inside of the forearm.

Protective gloves of this type have proved to be comparatively satisfactory but have also shown disadvantageous.

Since the protective strip, which covers the outside of the thumb, only reaches to the thumb root, the thumb can be bent backwards against the wrist, which can result in serious breaks at the thumb root which are sometimes difficult to heal. The padding on the upper side of the fingers and the palm of the hand certainly eases the knocks which occur against the upper side of the glove but do not always protect the hand and fingers against injuries, especially not from hard knocks with a pointed object such as the edge or end of an ice hockey stick.

The present invention is intended to remove the above-mentioned drawbacks and provide a protective glove, the effectiveness of which has up to now not been achieved.

According to the invention, this is achieved with the protective glove which is more closely defined in the appended claims.

The protective glove according to the invention is described in detail in the following with reference to the attached schematic drawings.

Figure 3:
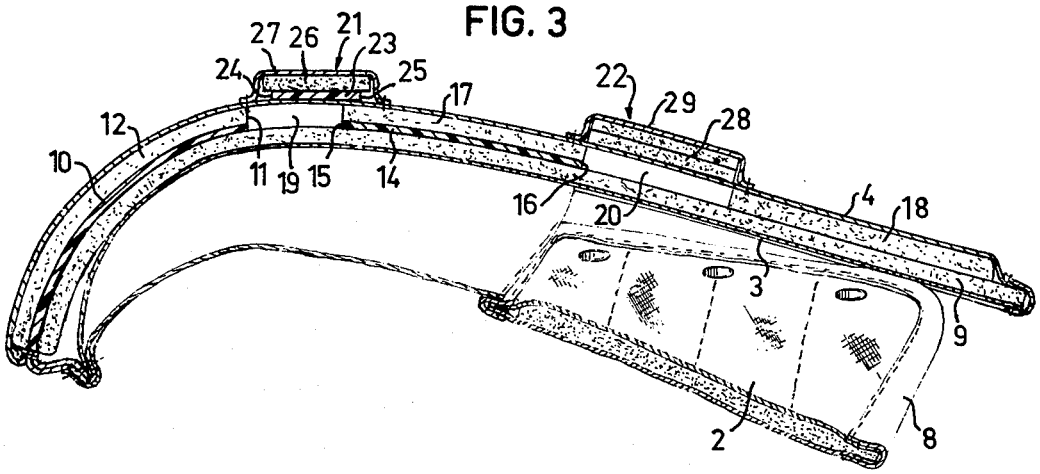
Figure 2:
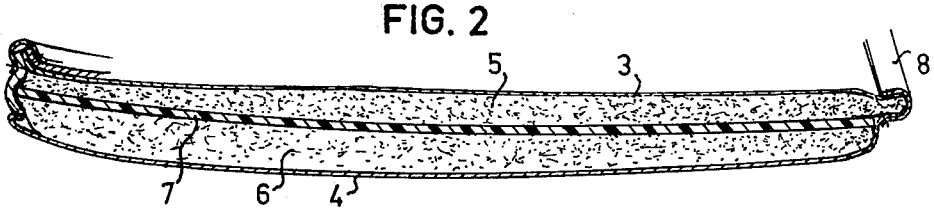

FIG. 1 shows in perspective the protective glove according to the invention seen from the upper side, FIG. 2 is a section along the line II-II in FIG. 1, and FIG. 3 is a section along the line III-III in FIG. 1.

The glove shown in FIG. 1 is comprised of a portion 1, intended to encircle the hand and fingers, and a cuff 2 which encircles the wrist and lower part of the forearm. Both the portion 1 and the cuff 2 are comprised of an inside covering layer 3 consisting of leather, plastic coated fabric or similar material, and the glove has the shape of a conventional glove with a thumbstall for the thumb and either a fingerstall for each of the four remaining fingers or a combined cover for these fingers. The protective glove can thus take the shape of a glove or a mitten. That part of portion 1 which covers the upper side of the fingers, the back of the hand and the outer side of the thumb also shows an outer covering layer 4 of the same material as the inner covering layer, and the cuff 2 of the glove is also provided with an outer covering layer 4 which preferably extends right around the cuff. The inner sides of the fingers, palm and thumb are thus only covered with the relatively thin inside covering layer 3.

Between the inner covering layer 3 and the outer covering layer 4 the glove is provided with protective elements which are intended to receive knocks and prevent bones breaking in the hand, wrist and forearm. These protective elements only cover the upper sides, so that the hand can freely hold an object, e.g. the top of an ice hockey stick.

According to FIGS. 1 and 2 the outer side of the thumb is covered with a padding in two layers 5, 6 of suitable material, e.g. foam plastic. Between these layers 5 and 6 there is a protective strip 7 of hard and relatively stiff material such as hard and stiff plastic. This protective strip 7 extends from the top of the thumb through that part of the portion 1 which covers the outer side of the thumb and into the cuff of the glove 2, preferably up to the edge 8 of the cuff. The layers 5 and 6 of the padding material cover the whole of the outer and inner surfaces of the protective strip 7, and thus also extend as far as the edge of the cuff 2. The protective element consisting of the layers 5 and 6 and the protective strip 7 thus covers the whole length of the thumb, the thumb root and the wrist as well as part of the forearm.

A force against the thumb which attempts to bend the thumb backwards and in against the wrist is taken up to a great extent by the protective strip 7, the inner end portion of which lies against the sides of the wrist and forearm. The thumb can be bent backwards and be injured only if the protective strip 7 is broken. This is not the case, however, with the known protective glove described in the introduction, in which the protective strip of the thumb only covers the two outermost bones of the thumb. The protective element 5, 6, 7 at the same time protects the outer sides of the thumb, thumb root, wrist and forearm against knocks.

According to FIG. 3, which shows details of the upper portion of the protective glove, there is an inner layer 9 of padding material which integrally extends through the portion 1 and the cuff 2 from the finger tops over the upper side of the fingers, palm, wrist and forearm up to the edge 8 of the cuff 2.

Within the portion of this layer of padding 9, which covers the upper side of the fingers, there is an integral protective plate 10 of hard and stiff material. The protective plate 10 covers the whole length of the fingers from the finger tops up to the vicinity of the outer edge of the innermost joints of the fingers. The plate 10 has an outline which mainly agrees with the outer contour of the fingers in a closed position, and therefore shows an arched front edge at the finger tops, mainly straight side edges along the outer edges of the index and little finger and an inner transverse straight edge 11. The protective plate 10 is furthermore curved seen sidewise, so that it mainly follows the upper surface of the fingers when the same are in a gripping position. An outer layer 12 of padding material is affixed to the outer side of the protective plate 10 and covers the whole of that side.

Inside the portion of the inner layer of padding 9, which covers the back of the hand, there is a second protective plate 14 of the same material as the protective strip 7 and the protective plate 10. This second protective plate 14 is in the front defined by a transverse edge 15 which is chiefly straight and which extends across the hand adjacent to the inner edge of the innermost joints of the fingers. The edge 15 is thus situated at a certain distance from the inner straight edge 11 of the protective plate 10. Behind, the protective plate 14 is defined by a second transverse edge 16 which is chiefly straight and which extends across the hand on a level with the outer edge of the wrist. The side edges of the protective plate 14 mainly follow the contour of the back of the hand, whereby its inner edge coincides with the grip of the thumb. The protective plate 14 is furthermore suitably somewhat curved laterally to adapt to the back of the hand when the hand is in the gripping position. The whole of the outer side of the protective plate 14 is covered with an outer layer 17 of padding material.

The portion of the cuff 2, which covers the upper side of the forearm, is also suitably provided with an outer layer of padding 18, which preferably takes the form of elongated cushions which are arranged parallel to each other in the longitudinal direction of the forearm. The front ends of these layers of padding 18 are situated on a level with the inner edge of the wrist and are thus at a certain distance from the inner edge 16 of the protective plate 14.

The protective element, which has so far been described, is arranged between the inner and the outer layer of covering 3, 4, respectively, and attached to these layers of covering by some suitable means, e.g. by means of adhesive. The layers of padding 5, 6, 9, 12, 17 and 18 are in a similar manner attached to the protective strips 7, and plates 10, 14, respectively.

From the above it should be seen that transverse empty spaces or zones 19, 20, respectively, are formed between the inner layer of the padding 9 and the outer layer of covering 4 within the transverse portions which are situated between the edge 11 of the protective plate 10, the edge 15 of the protective plate 14, and between the edge 16 of the protective plate 14, the outer ends of the cushions 18, respectively. These zones form bendable connections between the respective adjoining and relatively stiff parts of the glove, so that said glove can bend at the inner joints and wrist, respectively.

According to FIG. 1 the protective glove according to the invention is comprised also of protective elements 21 and 22, which extend across the hand and wrist, respectively, within said transverse zones 19 and 20.

According to FIG. 3 the protective element 21 comprises a third protective plate 23, which lies against the outer side of the outer layer of covering 4 and extends as a band across the hand. The front transverse edge 24 of the protective plate 23 is situated at some distance inside the back straight edge 11 of the first protective plate 10 and the outer layer of padding 12 of same. The transverse edge 25 of the back of the protective plate 23 is situated somewhat inside the front transverse edge 15 of the other protective plate 14 and the outer layer of padding 17 of same. On the outside, the third band-shaped protective plate 23 is coated with a strip 26 of padding material and the protective plate together with the padding strip is surrounded by a strip 27 of covering material which is sewn fast to the outer layer of covering 4 of the glove. With this design the protective element 21 does not to any appreciable degree impair the bendability within the zone 19 and this zone is at the same time effectively protected against knocks.

The protective element 22 within the zone 20 consists suitably of one or more strips 28 of padding material which strips rest against the outer layer of covering 4 and completely cover the zone 20. The strip or strips 28 of padding material are surrounded by a piece of covering material 29 which is sewn fast to the outer layer of covering.

The above-described embodiment of the protective glove according to the invention only constitutes a preferred embodiment and can undergo different modifications without departing from the idea of the invention as it is defined in the accompanying claims. Thus, for example, the stalls enclosing the thumb and fingers can, in the known manner, be separated from the cooperating protective elements at the outer ends of the fingers and only be attached to those protective elements by means of straps at the end of the stalls. The protective element 22 can also be formed in the same manner as protective element 21.

What we claim is:

1. A protective glove, especially for ice hockey players, said glove including an outer portion enclosing the fingers, an intermediate portion enclosing the hand, a cuff portion enclosing the wrist and lower part of the forearm and a stall portion enclosing the thumb, each of said portions comprising an inner layer and an outer layer, covering the inside and outside, respectively, of said fingers, hand, wrist with lower forearm portion and thumb, respectively, said inner and outer layers consisting of a thin pliable material, and each of said outer layers over substantially the whole area thereof having padding which is connected to adjacent padding over an elongated flexible joint, the padding of the thumb stall portion extending into and substantially all over the cuff portion along the adjacent side edge of the cuff portion padding and enclosing a protective strip which is of stiff material and which is of such a length as to reach all the way through the thumb stall padding in bridging relation to the thumb root.

2. A protective glove according to claim 1, and a first integral stiff protective plate that covers the upper side of the fingers from the tops of the fingers to the outer end of the inner joints of the fingers, and a second integral stiff protective plate that covers the back of the hand from the inner end of the above-mentioned joints up to the wrist, both sides of the protective plates being coated with padding material.

3. A protective glove according to claim 2, in which the first and the second protective plates on the side turned inwards are coated with an integral layer of padding material, whilst their sides turning outwards are coated with separate layers of padding material, a padding in the form of a transverse strip, which extends across the hand, being arranged to cover said inner joints and together with the integral layer of padding forming a bendable connection between said first and said second protective plates.

4. A protective glove according to claim 3, in which a third protective plate is arranged in the transverse padding.

5. A protective glove according to claim 4, in which said third protective plate is disposed outside said outer layer.

6. A protective glove according to claim 1, and a further transverse padding in the form of a strip on the upper side of the glove between the inner edge of the second protective plate and the cuff of the glove.

7. A protective glove, especially for ice hockey players, said glove including an outer portion enclosing the fingers, an intermediate portion enclosing the hand, a cuff portion enclosing the wrist and lower part of the forearm and a stall portion enclosing the thumb, each of said portions comprising an inner layer and an outer layer, covering the inside and outside, respectively, of said fingers, hand, wrist with lower forearm portion and thumb, respectively, said inner and outer layers consisting of a thin pliable material, and each of said outer layers over substantially the whole area thereof having padding which is connected to adjacent padding over an elongated flexible joint, a first integral stiff protective plate that covers the upper side of the fingers from the tops of the fingers to the outer end of the inner joints of the fingers, a second integral stiff protective plate that covers the back of the hand from the inner end of the above-mentioned joints up to the wrist, both sides of the protective plates being coated with padding material, padding in the form of a transverse strip which extends across the hand and covers said inner joints and together therewith forms a bendable connection between said first and said second protective plates, and a third protective plate in said transverse strip of padding, said third protective plate being disposed outside said outer layer.

8. A protective glove according to claim 7, in which said protective plate is disposed on the inner side of said transverse strip of padding.

* * * * *